US007370842B2

(12) United States Patent
Fritz

(10) Patent No.: US 7,370,842 B2
(45) Date of Patent: May 13, 2008

(54) SUPPORT STRUCTURE WITH SELF-ADAPTING SUPPORT SURFACE FOR RECEIVING ANY TYPE OF BODY

(76) Inventor: Dominique Henri Fritz, 41 bis, avenue de Montjoux, F-25000 Besançon (FR)

( * ) Notice: Subject to any disclaimer, the term of this patent is extended or adjusted under 35 U.S.C. 154(b) by 319 days.

(21) Appl. No.: 10/513,330

(22) PCT Filed: May 13, 2003

(86) PCT No.: PCT/FR03/01451

§ 371 (c)(1),
(2), (4) Date: Aug. 7, 2005

(87) PCT Pub. No.: WO03/094669

PCT Pub. Date: Nov. 20, 2003

(65) Prior Publication Data

US 2006/0097125 A1 May 11, 2006

(30) Foreign Application Priority Data

May 14, 2002 (FR) ..... 02 05890

(51) Int. Cl.
*F16M 13/00* (2006.01)

(52) U.S. Cl. ..... 248/564; 248/163.1; 367/151

(58) Field of Classification Search ..... 248/564, 248/163.1, 371; 5/236.1; 297/151
See application file for complete search history.

(56) References Cited

U.S. PATENT DOCUMENTS 3,181,858 A * 5/1965 Daniels ..... 269/296
3,419,238 A * 12/1968 Flory ..... 248/163.1
3,790,150 A * 2/1974 Lippert ..... 267/151
4,033,567 A * 7/1977 Lipfert ..... 267/151
4,238,864 A * 12/1980 Kealoha ..... 441/25
4,374,497 A * 2/1983 Harmand ..... 108/4
4,559,656 A * 12/1985 Foster ..... 5/236.1
5,545,040 A * 8/1996 Lu ..... 434/58
6,425,153 B1 * 7/2002 Reswick ..... 5/655.9
6,962,259 B2 * 11/2005 Hu ..... 211/1.51

* cited by examiner

*Primary Examiner*—Anita M. King
(74) *Attorney, Agent, or Firm*—Jackson Patent Law Office

(57) ABSTRACT

An exemplary support structure has an auto-adaptable surface. The exemplary support structure comprises a base; an assembly of distinct, adjacent contacts; and an assembly of platforms of a common level forming a common tier, each platform being linked to the base by an articulation. The platforms have multiple branches, each branch supporting a contact, and the contacts and the platforms have three degrees of freedom in rotation. Thus, the contacts are linked to the base such that they are mobile with respect to each other and with respect to the base to form the auto-adaptable support surface.

23 Claims, 5 Drawing Sheets

SUPPORT STRUCTURE WITH SELF-ADAPTING SUPPORT SURFACE FOR RECEIVING ANY TYPE OF BODY

TECHNICAL FIELD

The present invention concerns a support structure with a self-adapting surface for receiving any type of body, this support structure comprising at least a base and an assembly of distinct, adjacent contacts linked to the aforementioned base by linking means such that they are mobile with respect to each other and with respect to the aforementioned base to form the aforementioned auto-adaptable support surface, the linking means comprising at least an assembly of platforms of a common level forming a common tier, each plate form being linked to the base by at least an articulation, the assembly formed by an articulation, at least a platform of the corresponding contacts defining a base module.

PRIOR TECHNOLOGY

Various support structures exist. They can be utilized for the comfort of persons, for example, in mattresses, seats, sofas, etc. They can also be utilized, in industry, in shock absorbing supports, and moving pads for packing or transporting fragile, precious, and/or voluminous objects.

In a known manner, certain support structures, such as those for example utilized in furniture for mattresses or sofas, are made of a synthetic foam structure. Nevertheless, these foam structures are not satisfactory because they have a tendency to be compacted in their body support zones. In these zones, the density of foam is concentrated, making these support structures uncomfortable and making the distribution of forces non-homogeneous on the assembly of the support surface. Utilization of such support structures in the hospital environment is strongly contraindicated because they induce, in the body support zones, excessive tissue compression and a perturbation of blood circulation possibly to the point of scabs. Furthermore, the foam structures can be difficult to wash and disinfect. They favor, consequently, proliferation of microbes and bacteria. These support structures are also difficult to recycle.

Other support structures can be also utilized in furniture comprising an envelope filled with air or water. The inflation or filling of these support structures can be modified during utilization more or less frequently to, for example, promote blood circulation of bedridden persons. The envelope can form a single watertight chamber or be divided into compartments waterproof between themselves or not. When there is communication of air or water between the different compartments of the envelope, these support promote the distribution of body weight on the entire support surface. Nevertheless, these support structures present major disadvantages. In fact, they are expensive, inconvenient and the air tightness of their envelope favorizes perspiration of persons and makes them uncomfortable. Furthermore, water mattresses are particularly heavy to manipulate and cannot be utilized except in horizontal position.

In the same spirit, more complex support structures implement a waterbed, covered by floating wood logs. These support structures present numerous disadvantages among those cited previously and are not therefore satisfactory.

There are also spring support structures. These do not however guarantee a uniform distribution of resulting forces of the support surface on the body. In the particular example of a nonplaner object supported on such a support structure, the springs situated under the raised zones are strongly strained while the adjacent springs are not. The weight of the object is therefore concentrated and carried by several springs while the rest of the object is unsupported or little supported on the support surface. In the case of transporting fragile or voluminous objects, these localized forces can lead to damage, even breakage, of the objects in question. The resulting forces from the support structure being non-uniformally distributed on the body, mattresses using these spring support structures are contraindicated in the hospital environment for the reasons presented above.

Other types of auto-adaptable support structures such as that described in the publication FR-A-2 064 944 enable distribution of the support pressure of a body. This support structure comprises a base supporting a ramified frame provided with a first articulated lever, by means of a pivot, with respect to the base. This first lever supports two articulated second levers, by means of pivots, with respect to the first lever. Each second lever supports four articulated third levers, by means of pivots, with respect to the second levers. The second and third levers have an H form whose branch ends support the pivots. The third levers support plates in their ends forming a support surface, these plates being articulated, by means of pivots, with respect to the third levers. This articulated support structure comprising tiered articulations pivots is cumbersome and limits the movements to one degree of freedom in rotation by pivot. Furthermore, it requires a number of large pieces with an elevated weight and cost of manufacture. This solution is therefore not satisfactory.

Finally, publication U.S. Pat. No. 6,217,121 describes a therapeutic cushion made of approximately vertical rods of which the free ends are spherical and form a support surface. These rods are combined with springs giving them vertical mobility for adopting the support surface to the profile of the body that they support. The mobility not being vertical, the deformation ability of this support structure is limited. Furthermore, rubbings between the vertical rods are prejudicial to the efficiency of this support structure, which is not satisfactory.

DESCRIPTION OF THE INVENTION

The present invention aims to compensate for these disadvantages by proposing a support structure having an auto-adaptable support surface, of low weight, low bulk, low cost, hygienic, being able to be easily washed and disinfected, having a long life, having an elevated contact density and enabling distribution of the resulting forces from the support structure in an approximately uniform and homogenous manner on the object or the person being supported by such a structure.

Towards this end, the invention concerns a support structure of the type indicated previously, characterized in that the platforms have a star shape with three branches of which each supports a contact and in that the articulations are selected from the group including at least mechanical ball and socket joints and elastic links such that the contacts and the platforms have three degrees of freedom in rotation.

In a preferred implementation, the linking means comprise a number "n" of platform assemblies of different levels defining a number "n" tiers, the platforms of the tier "n" supporting the contacts, each platform of the tier "n" being linked to a platform of the tier "n−1" by at least an articulation, each platform of the level "n−1" supporting at least two platforms of the tier "n" and being linked to a platform of the tier "n−2" by at least an articulation, each platform of the first tier being linked at the base by at least an articulation, the platforms having a star shape comprising three branches and the articulations being selected from the group including at least mechanical ball-and-socket joints, and elastic links.

The support structure favorably comprises several adjacent base modules arranged so that the platforms fit into each other.

The platforms and the contacts are preferably arranged so that the contacts occupy more than 85% of the surface of the support surface.

According to a first implementation mode, the articulations are formed from different pieces and attached to the platforms.

According to a second implementation mode, the articulations are at least in part integrated with the platforms in a manner to form monoblock pieces with the platforms.

The support structure favorably comprises returning means arranged for co-operating with the articulations for restoring the platforms in their initial position when the support structure is no longer subject to a supported body. The returning means can be selected from the group including at least springs, elastic washers, elastomer wedges, and leaf springs.

In the preferred implementation, the articulations and returning means are constituted by a single piece made of elastic material.

Preferably, the articulations linking the platforms of a tier "n" to the platforms of a tier "n−1" or to the base are arranged approximately at the center of gravity of each platform of the tier "n" to form a balance. The contacts supported by the platform of the tier "n" are arranged around its center of gravity. And the articulations linking the platforms of a tier "n−1" to the platforms of a tier "n" are arranged around the center of gravity of each platform of the tier "n−1".

According to the preferred implementation mode, the arms of the star-shaped platforms are separated two by two by an angle approximately equal to 120° and the platforms of a common tier are approximately identical.

The platforms can be realized in an elastically deformable material.

The platforms of the tier "n" can be adjacent and contiguous and comprise a connection mechanism arranged to limit their relative displacement. This connection mechanism can be made of a flexible elastic connection arranged around the contiguous contacts of at least two contiguous platforms.

This support structure can also comprise guiding means for the aforementioned contacts. These guiding means can be made of an openwork surface defining guiding orifices for receiving the contacts, the openwork surface being selected from the group including at least a grill, a meshing, and a perforated plate. These guiding means can also comprise an elastic surface arranged on the contacts, these contacts being unified to the elastic surface by a technique selected from the group including at least gluing, riveting, and welding.

These contacts can have a section shape selected from the group including at least a cylinder, a hexagon, and a square. They favorably include at their free end an at least partially spherical head, are realized in a deformable elastic material and are arranged to define an approximately flat support surface when the support structure is not subject to a supported body.

BRIEF DESCRIPTION OF THE DRAWINGS

The present invention and its advantages will be more apparent in the following description of an implementation example, in reference to the attached drawings, in which.

POSSIBILITIES OF INDUSTRIAL APPLICATION

The support structures in general can be utilized for numerous applications requiring a vertical, oblique, horizontal, or other support, of all kinds of bodies, of persons and/or objects.

In a first category of applications, the support structures are utilized in the field of comfort and serve as supports for seated or bedridden persons. These supports can be beds (anti-bedsore for example), seats for relaxation (at the dentist's office for example), armchairs, sofas, armless chairs, deck chairs, desk chairs, passenger seats in cars, airplanes, busses, trains, cushions (for wheel chairs for example), for stretchers, for rescue sleighs, or any other ambulance equipment, rehabilitation mattresses especially immergable for being utilized in a pool. These supports can also be soles (orthopedic for example).

In a second category of applications, these support structures are utilized in the field of transport and serve as supports for objects (fragile and/or costly and/or voluminous for example). These supports can be cushioning wedges for example utilized for cushioning objects in a container, and intermediate wedges arranged for example between a roller conveyor and an object to be moved, the intermediate wedge being able to accompany the object during its displacement.

A third category groups varied applications such as for example padding for backpacks, fabrication of cushioned walls or floors for example for sports halls, confinement rooms, and playrooms for children, the structure itself being able to constitute a game for children.

The description relates in a non-limiting way to a support structure in the first category of applications and utilized as mattresses for anti-bedsore bed intended for the hospital environment. It is quite obvious that the invention applies equally to the structures of support in the other categories of applications cited previously.

BEST MODE OF IMPLEMENTING THE INVENTION

Referring to the figures, this support structure 1 comprises a base 2, an assembly of distinct and adjacent contacts 3 forming the auto-adaptable support surface as well as linking means linking the contacts 3 to the base 2 in a mobile fashion.

Figure 5:
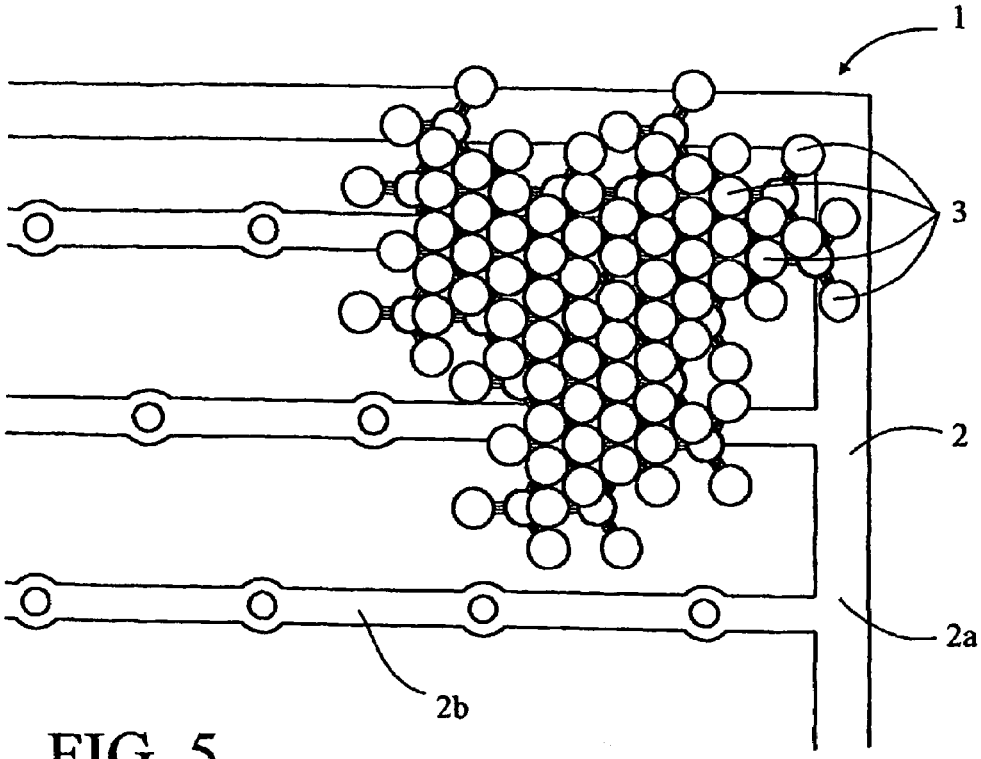
FIG. 5 is a plan view of several subassemblies arranged on a support to form a support structure according to the invention.
Figure 6:
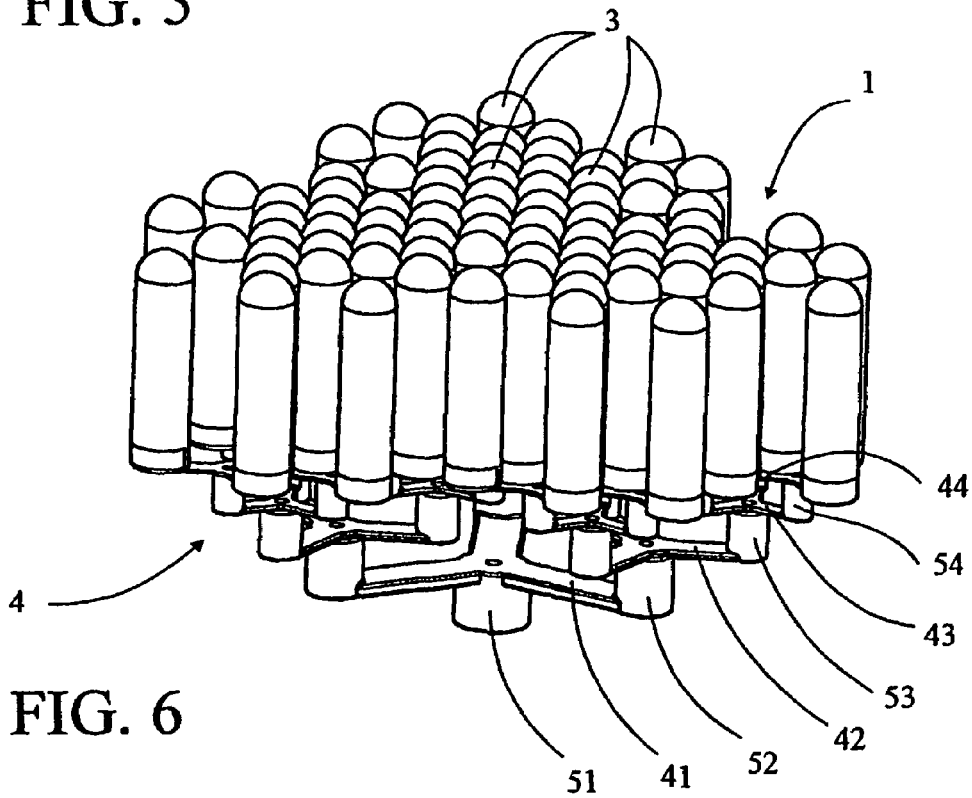
FIG. 6 is a complete perspective view of the subassembly of FIG. 4.

The base 2 is made of a frame 2*a* represented in FIG. 5, of which the side borders are linked by crosspieces 2*b*. The base 2 can also be made of a solid or openwork plate, a network of parallel or non-parallel tubes, or of any other equivalent auto-supporting support. This base 2 is for example realized in synthetic material, wood, composite materials, metal, or any other equivalent material. The support structure 1 can comprise one or several bases 2 arranged adjacently or non-adjacently, linked between themselves or not, and possibly jointed with respect to each other. Each base 2 can have reduced dimensions on the order of several square centimeters or larger dimensions of the order of several square meters. The bases 2 can comprise feet or be positioned on the bare ground or on any other surface support.

Figure 1:
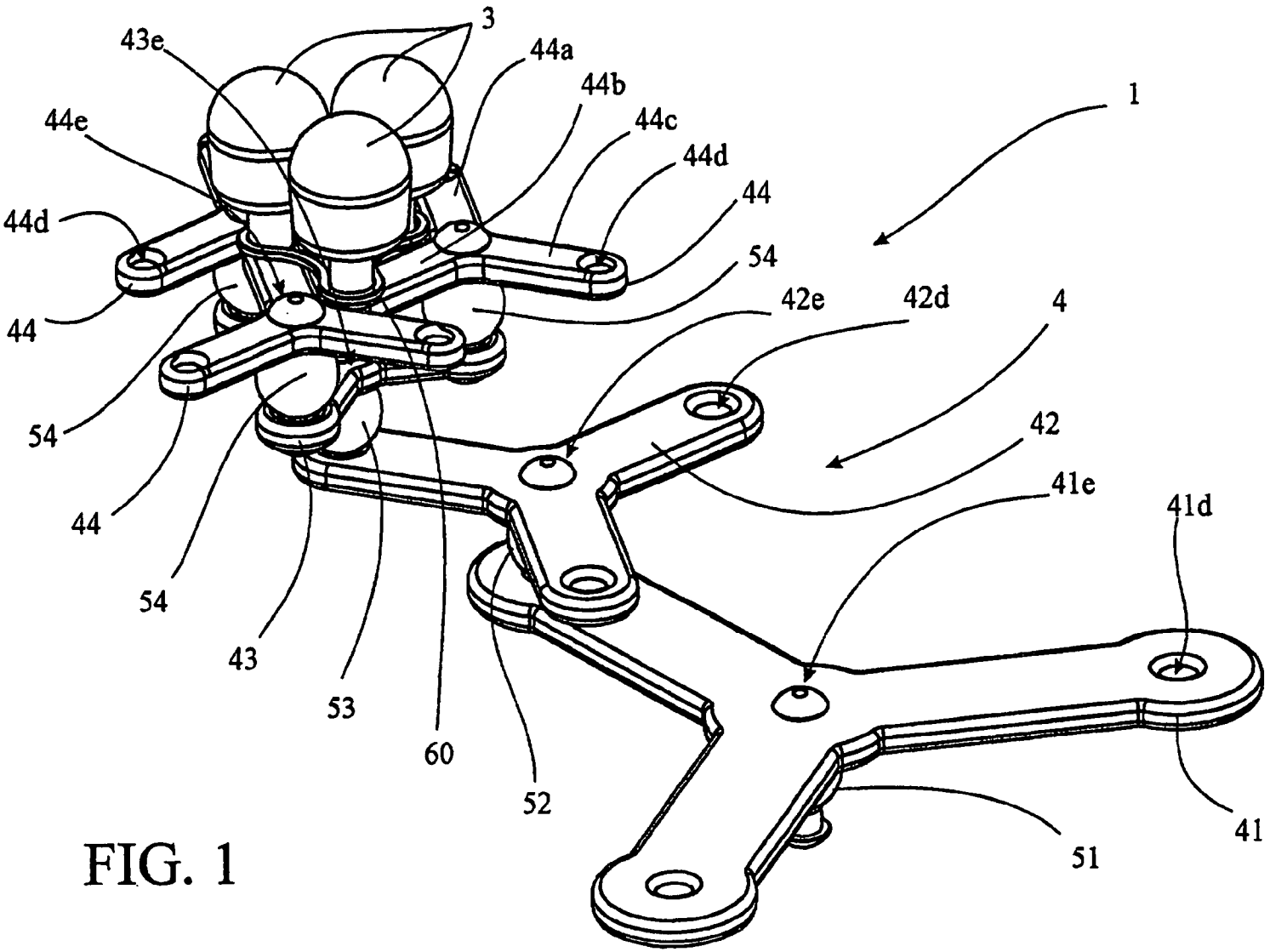
FIG. 1 represents a partial perspective plan view of a subassembly of a support structure according to the invention.
Figure 2:
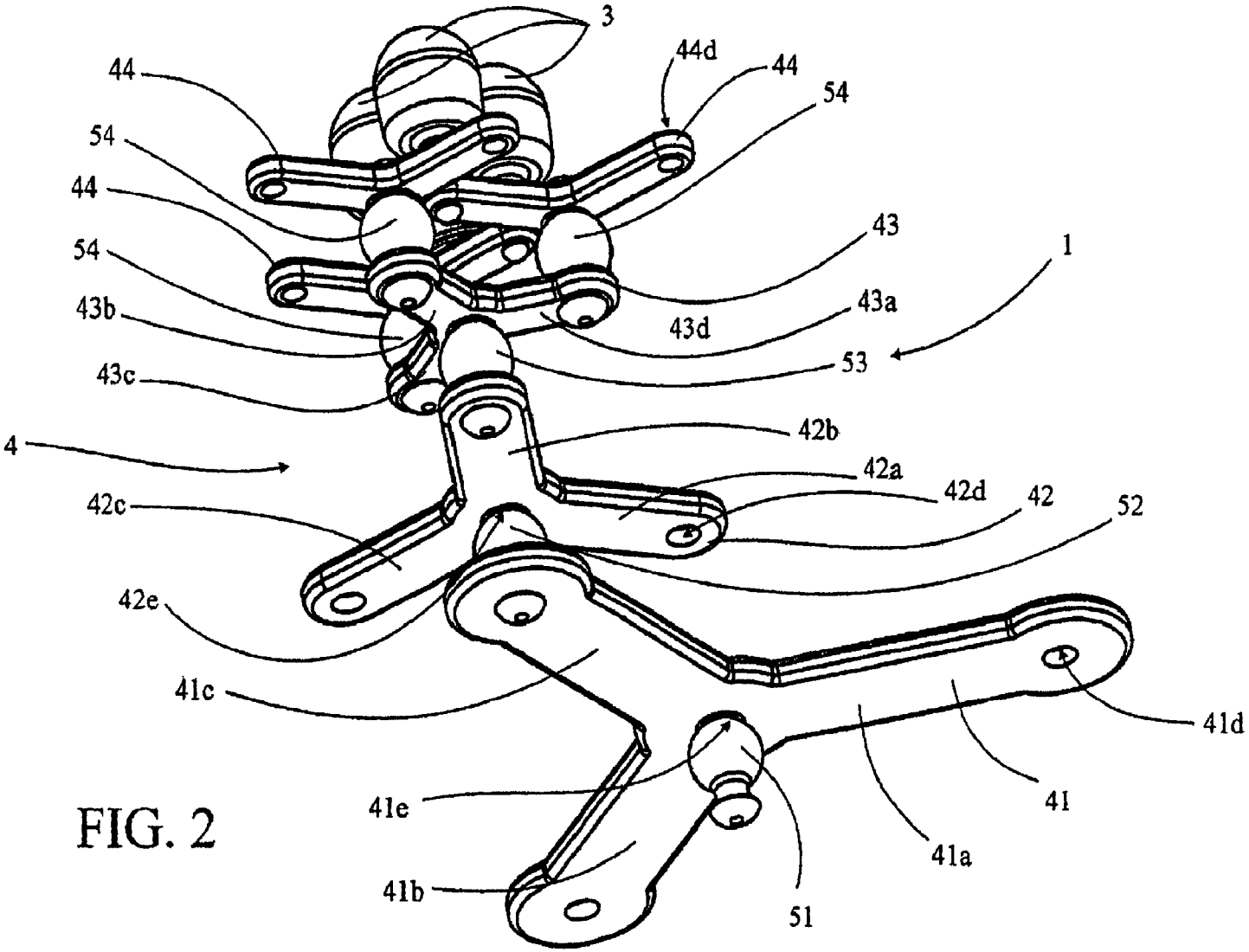
FIG. 2 is a partial perspective bottom view of the subassembly of FIG. 1.
Figure 3:
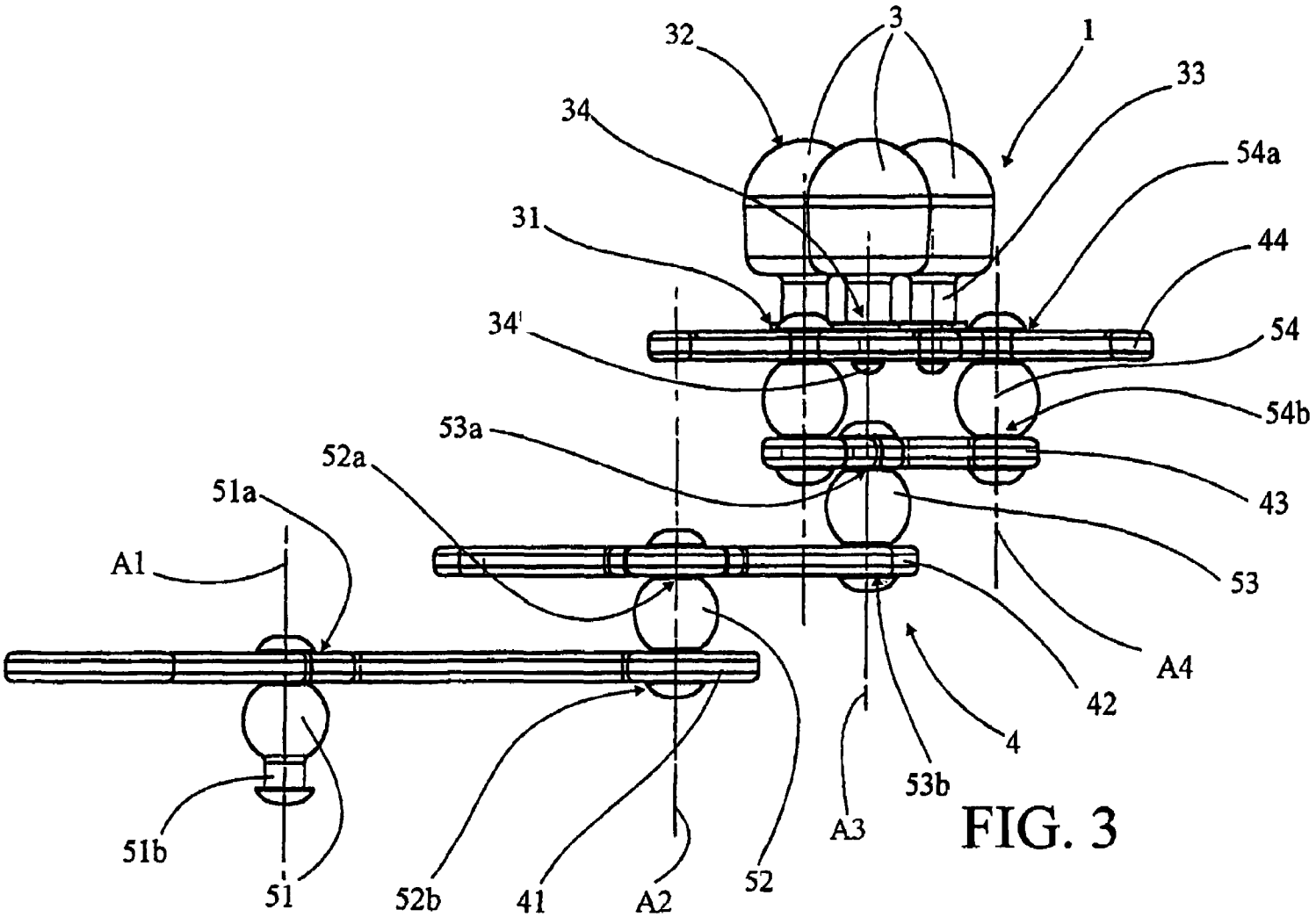
FIG. 3 is a partial side view of the subassembly of FIG. 1.

The contacts 3 each comprise an inferior end 31 coupled to the linking means 4 and a superior end 32 free forming the auto-adaptable support surface of the support structure 1. The contacts 3 have a cylindrical section but can also have a hexagonal or square section, or any other adapted form. In the represented implementation mode (CF. FIG. 3), each contact 3 comprises a rod 33 (cylindrical for example) presenting towards its inferior end 31 a reduction of diameter defining two opposed fortifications 34,34' utilized, as detailed further, for unifying the contacts 3 with the linking means 4 by interlocking as illustrated or by the agency of a pin (not represented) or by any other equivalent means. In another implementation mode not represented, the contacts 3 can be glued on the linking means 4. The free end of the contact 3 comprises a hemispheric head 32 of which the diameter is greater than that of the rod 33. This head 32 enables the surface of the contact 3 subject to the supported body on the support structure 1 to be approximately constant whatever the position of the contact 3. The rod 33 and the head 32 can be formed from a single piece or from several assembled pieces. The head 32 is for example coupled to the rod 33 to which it is linked in rotation by a linking pivot. The rod 33 and/or the head 32 can be rigid and realized in manufactured or molded synthetic material, wood, composite material, metal and alloys, or any other equivalent material. It can also be realized in deformable elastic materials, for example in rubber, elastomer, or any other equivalent material.

Referring more particularly to FIGS. 1-4, the linking means 4 comprise an assembly of platforms 41-44 linked among themselves and/or to the base 2 (not represented in these figures) by articulations 51-54 so that the platforms 41-44 are mobile between themselves and with respect to the base 2.

The platforms 41-44 are arranged as illustrated on several levels, each level forming a tier "n". The support structure 1 comprises in this manner a multitude of tiers "n" according to needs, the minimal support structure 1 being able to comprise a single tier.

In a general manner, in a support structure 1 comprising "n" tiers, the platforms of the tier "n" each support at least two contacts 3. Each platform of the tier "n" is linked to the platform of the tier "n−1" by an articulation, each platform of the tier "n−1" is linked to the platform of the tier "n−"2 by another articulation and so on up to the first tier linked to the base 2 by another articulation. The platforms are arranged so that each platform of an inferior tier "n−1" supports at least two platforms of the superior tier "n".

The illustrated example shows a support structure 1 having four tiers. In this manner, and in reference to FIGS. 1 to 3, in this support structure 1, each platform 44 of the fourth tier supports three contacts 3 and is linked at its center to a platform 43 of the third tier by an articulation 54. Each platform 43 of the third tier supports three platforms 44 of the fourth tier and is linked at its center to a platform 42 of the second tier by an articulation 53. Each platform 42 of the second tier supports three platforms 43 of the third tier and is linked at its center to a platform 41 of the first tier by an articulation 53. Each platform 41 of the first tier is linked at its center to the base 2 by an articulation 51 to the base 2. The assembly formed by an articulation 51, the platforms 41-44 that are linked to it, as well as the corresponding contacts 3 form a base module and the support structure 1 is the result of identical base modules arranged in an adjacent manner. The number of these base modules depends on the support surface to be implemented.

In the example represented, the platforms 41-44 are symmetric with respect to an axis or with respect to a plane passing through their center of gravity. They are for example fabricated from plates made of synthetic material, wood, composite materials, metal, or any other equivalent material of thickness varying according to the material utilized in a manner generally greater than 1 mm. They can be realized in rigid materials or, preferably, in elastically deformable material. The platforms 44 of the fourth tier supporting three contacts have for example exterior dimensions inscribed in a circle from 60 to 170 mm and the platforms 41 of the first tier have exterior dimensions inscribed in a circle preferably superior to 170 mm.

Figure 4:
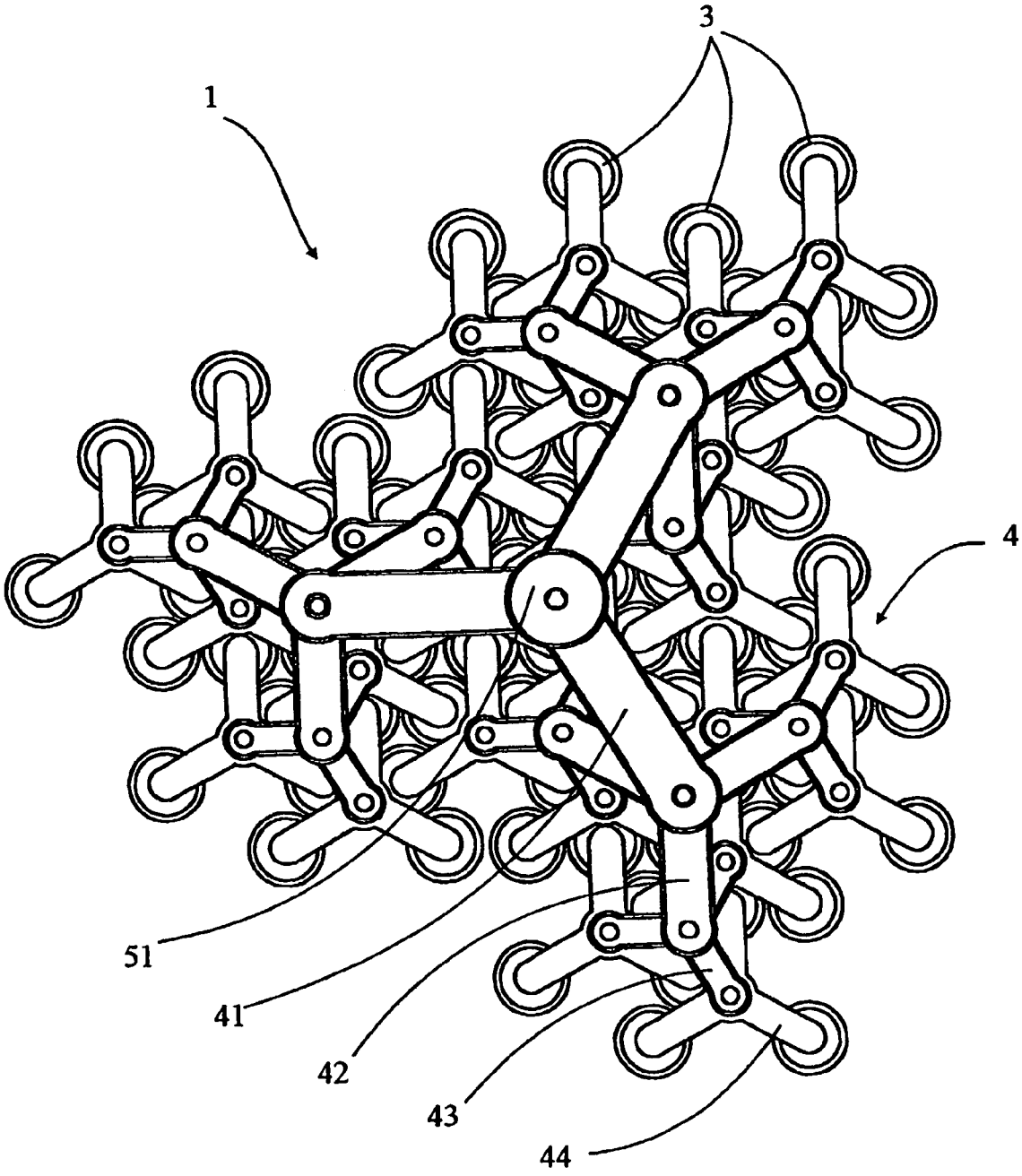
FIG. 4 is a complete bottom view of the subassembly of FIG. 1.

The platforms 41-44 have a star shape with three arms 41 to 44 *a, b,* and *c*. Of course the platforms 41-44 of a common tier or of different tiers can be realized in different materials, rigid or elastically deformable. The star shape is particularly advantageous because it enables the platforms 41-44 of a common tier to fit into each other as illustrated by FIG. 4. In this manner, the platforms of the superior tier are arranged such that the contacts are adjacent to form a homogenous and dense surface. With cylindrical contacts of 2.5 cm diameter, one attains in this manner a rate of coverage greater than 85% with respect to the total surface of the support structure 1. Such results cannot be obtained with platforms having other forms.

The platform 44 of the fourth tier comprises orifices 44*d* intended for attachment of the contacts 3. The other platforms 41, 42, 43 comprise orifices 41*d*, 42*d*, 43*d* for the attachment respectively of the articulations 52, 53, 54. Each platform 41-44 also comprises orifices 41*e*-44*e* for the attachment respectively of the articulations 51-54. All these orifices are preferably identical and cylindrical but can also be different and have any other adapted form. For the platform 44, the orifices 44*d* provided for the contacts 3 are symmetrically arranged around the center of gravity of the platform 44 and at the end of each arm of the star. Similarly, for each platform 41, 42, 43, the orifices 41*d*, 42*d*, 43*d*, provided for the articulations 52, 53, 54, are symmetrically arranged around the center of gravity of the platform 41, 42, 43 and at the end of each arm of the star. The orifices 41*e*-44*e* provided for the articulations 51-54 are preferably each arranged at the center of gravity of the platform 41-44. In this manner, each platform 41-44 with the articulation 51-54 to which it is associated and linked to an inferior platform form a balance that is inclined as a function of the applied load on the contacts 3 by the supported body on the support structure 1. This balance enables distribution of the weight of the body between the contacts 3 of the support surface, which is consequently deformed so that each zone of the supported body is subjected to a resultant force from the support structure 1 approximately equal and homogeneous.

The articulations 51-54 can be made of pieces of elastically deformable or rigid material and utilized in combination with elastically deformable or rigid platforms 41-44. An articulation 51-54 made of elastically deformable material can in this manner be combined with a platform 41-44 made of elastically deformable or rigid material. Similarly, an articulation 51-54 made of rigid material can in this manner be combined with a platform 41-44 made of elastically deformable or rigid material.

According to an implementation form not represented, the articulations 51-54 are made of pieces integrated to platforms 41-44 forming with them monoblock pieces. Each articulation 51-54 can in this manner comprise two parts, a first part integral with a first platform of a tier "n", a second part integral with platform of a tier "n−1", the two parts being arranged to interlock and form the articulation 51-54. Each articulation 51-54 can also comprise three parts, a first part integral with a first platform of a tier "n", a second part integral with a platform of a tier "n−1", a third part intermediately placed between the first and second parts in which it is interlocked to form with them the articulation 51-54.

When the articulations are made of pieces distinct from platforms 41-44 and attached, they are interlocked at their ends in the corresponding orifices between a plate of a tier "n" and a plate of a tier "n−1". These articulations are either mechanical ball and socket joints, or elastic links and present the advantage of concentrating, in a limited zone, the three degrees of freedom in rotation, which is not possible with pivot links. In this manner, the mobility of each contact 3 and of each platform 41-44 is increased and the comfort of the support structure 1 improved.

The articulations 51-54 can also cooperate with returning means restoring the platforms into their initial position when the support structure 1 is no longer stressed by a supported body. These returning means are for example springs, elastic washers, wedges made of elastomer, or leaf springs.

In the represented implementation form, the articulations 51-54 and the returning means are made of a single piece realized in elastic material for example through the axis A1-A4 and approximately symmetric with respect to a median plane approximately perpendicular to the axis A1-A4. Each articulation 51-54 fulfills the function of articulation and of returning means. These articulations 51-54 are cylindrical and comprise on each side of their median plane zones of a smaller diameter 51*a*, 51*b*-54*a*, 54*a* defining opposed fortifications utilized for unifying the articulations 51-54 to the platforms 41-44 and/or to the base 2 by interlocking. The median part of each articulation 51-54 situated between the zones 51*a*, 51*b*-54*a*, 54*a* has a partially spherical shape enabling it to not hamper the inclination of platforms 41-44 with respect to each other and with respect to the base 2. These articulations 51-54 can of course present different forms and be linked to platforms 41-44 and/or to the base 2 by gluing, welding, screwing, or any other equivalent means. These articulations 51-54 can also be formed from one or several pieces.

In the example represented, the platforms 44 of the fourth tier are arranged in an adjacent and contiguous manner and are linked between themselves by a linking member 60 limiting their relative displacement. This linking member 60 is formed of a flexible elastic line or of any other equivalent means. It is arranged around three contiguous contacts 3 of three adjacent platforms 44. This flexible line 60 allows avoiding that, in certain positions, the platforms 44 overlap themselves and remain jammed in this position. This flexible line 60 further contributes to restore the platforms 44 into their initial position when the support structure 1 is no longer subject to a supported body. In the same manner, other linking members can be provided between the platforms 43 or 42 or 41 when they are arranged in an adjacent and contiguous manner.

The platforms 41-44 can also have particular forms and dimensions limiting any risk of overlapping. The star form such as that represented is as such recommended. Similarly, the edges of the stars can be rounded or beveled so that in case of overlapping the platforms 41-44 do not remain jammed.

In a general manner and referring to the example illustrated by the figures, the base 2 is approximately flat, the platforms 41-44 are approximately parallel to the base 2 and the contacts 3 are approximately perpendicular to the platform 44 of the fourth tier.

In this manner, at rest that is to say when the support structure 1 is not subject to a supported body, the contacts 3 define an approximately flat support surface.

When a person takes support on the support structure 1, the platforms 44, then 43, then 42, then 41 tilt until equilibrium. This particular original arrangement also enables all the contacts 3 of the support structure 1 subject to the supported body to exert an approximately equal resultant force on the supported body. This equilibrium is obtained regardless of the position of utilization of the support structure 1, horizontal, vertical or oblique and regardless of the supported body, person and/or object. When the body is displaced on the support structure 1, the articulations 51-54 forming returning means permit the support structure 1 to automatically re-equalize itself and the contacts 3 to follow the displacement of the body.

The platforms 41-44 and the contacts 3 can be dimensioned so that the contacts 3 are contiguous among themselves and the support surface is maximal. When a body supported on the support structure 1 and the contacts 3 are contiguous, they guide themselves with respect to each other in their displacement.

According to implementation variations, the contacts 3 can be associated with guiding means guiding them in their displacement when the support structure 1 is subject to a supported body. These guiding means can be made by a surface covering the support surface formed by the contacts 3, this surface being openwork defining a guiding orifice for each contact 3, as for example a grill, a mesh work, a perforated plate made of any adapted material. These guiding means can also comprise an elastic surface placed on the contacts 3, the contacts 3 being unified to the elastic surface by a technique selected from the group including at least gluing, riveting, and welding. The surface is for example made of Gortex®, Dartex®, fabric of natural, synthetic or artificial fibers, etc.

When the contacts 3 cover most of the support surface, each contact 3 can be traversed by an orifice oriented toward the support surface. This orifice promotes the circulation of air through the support structure 1, limiting in this manner the perspiration of the supported person. These orifices can also be utilized for the passage a fluid, of a liquid or of a gas, for example of air being able to be air-conditioned.

The amplitude of the deformation of the auto-adaptable support surface depends notably on the dimension of the platforms 41-44 as well as the number of "n" of tiers. The larger the platforms 41-44, the more each balance will have a large amplitude. The larger the number "n" of tiers, the more the amplitude of the deformation will be large.

The support structures 1 according to the invention can be easily cleaned, disinfected and aseptized due to their design and the materials utilized. This aspect is particularly useful and important when these support structures 1 are utilized for a hospital environment. This cleaning is carried out by for example aspersion or by immersion in a cleaning liquid and/or disinfectant. The hospital mattresses constituted by such a support structure can be in this manner entirely disinfected between two patients, which limits the risk of contamination and of secondary infection.

Depending on the materials chosen, they can have a very long lifetime making them particularly economical over the long term.

The support structure 1 can also be utilized in combination with a vibration device stimulating the structure in a random manner for massaging and/or to promoting the circulation of blood. This combination is particularly appreciable for the long term bedridden.

This description clearly shows that the invention enables meeting the goals set forth and notably obtaining a light, effective and economical structure. The utilization of socket and/or elastic links enables, with a limited number of pieces and a reduced bulk an optimum mobility of the contacts forming the support surface. The contacts define unitary support surfaces of reduced dimensions. The separation between adjacent contacts is limited to the maximum due to the star-shaped platforms. In this manner, the support surface obtained is "full" and has a high degree of deformation fineness in a manner to uniformly distribute the resultant forces of the support structure on the object or the person supported below.

The present invention is not limited to the described implementation example but extends to any obvious modification and variant for a person in the field entirely remaining within the scope of protection defined in the annexed claims.

The invention claimed is:

1. A support structure having an auto-adaptable surface, the support structure comprising:

a base;

an assembly of distinct, adjacent contacts; and an assembly of platforms of a common level forming a common tier, each platform being linked to the base by an articulation, the assembly formed by an articulation, a platform and the corresponding contacts defining a base module, characterized in that the platforms have three branches, each branch supporting a contact, and in that the contacts and the platforms have three degrees of freedom in rotation, whereby the contacts are linked to the base such that they are mobile with respect to each other and with respect to the base to form the auto-adaptable support surface.

2. The support structure according to claim 1, further including a number "n" of assemblies of platforms of different levels defining a number "n" tiers, the platforms of the tier "n" supporting the aforementioned contacts, each platform of the tier "n" being linked to a platform of the tier "n−1" by an articulation, each platform of the level "n−1" supporting two platforms of the tier "n" and being linked to a platform of the tier "n−2" by an articulation, and each platform of the first tier being linked to the base by an articulation, the platforms having a star shape comprising three branches and the articulations being selected from the group consisting of mechanical ball-and-socket joints, and elastic links.

3. The support structure according to claim 1, characterized in that it comprises guiding means for the contacts.

4. The support structure according to claim 3, characterized in that the guiding means comprise an openwork surface defining guiding orfices for receiving the contacts, the openwork surface being selected from the group consisting of a grill, a meshing, and a perforated plate.

5. The support structure according to claim 3, characterized in that the guiding means comprise an elastic surface arranged on the contacts, the contacts being unified to the elastic surface by a technique selected from the group consisting of gluing, riveting, and welding.

6. The support structure according to claim 1, characterized in that the contacts have a section shape selected from the group consisting of a cylinder, a hexagon, and a square.

7. The support structure according to claim 1, characterized in that the plots are provided with an partially spheric head (32) at their free end.

8. The support structure according to claim 1, characterized in that the plots are realized in a deformable elastic material.

9. The support structure according to claim 2, characterized in that the platforms of a common tier are approximately identical.

10. The support structure according to claim 1, characterized in that the plots are arranged to define an approximately flat support surface when the support structure is not subject to a supported body.

11. The support structure according to claim 1 further including several adjacent base modules arranged so that the platforms fit into each other.

12. The support structure according to claim 11 wherein the platforms and the contacts are arranged so that the contacts are adjacent and occupy more than 85% of the support surface.

13. The support structure according to claim 1 wherein the articulations are formed from different pieces and attached to the platforms.

14. The support structure according to claim 1 wherein the articulations are in part integrated with the platforms in a manner to form with the platforms monoblock pieces.

15. The support structure according to claim 14 further including returning means arranged for co-operating with the articulations for restoring the platforms in their initial position when the support structure is no longer subject to a supported body.

16. The support structure according to claim 15 wherein the returning means is selected from the group consisting of springs, elastic washers, elastomer wedges, and leaf springs.

17. The support structure according to claim 15 wherein the articulations and returning means are constituted by a single piece made of elastic material.

18. The support structure according to claim 1 wherein the articulations linking the platforms of a tier "n" to the platforms of the tier "n−1" or to the base are arranged approximately at the center of gravity of each platform of the tier "n" to form a balance.

19. The support structure according to claim 18 wherein the articulations linking the platforms of a tier "n−1" to the platforms of a tier "n" are arranged around the center of gravity of each platform of the tier "n−1".

20. The support structure according to claim 1 wherein the arms are separated two by two by an angle approximately equal to 120°.

21. The support structure according to claim 1 wherein the platforms are realized in an elastically deformable material.

22. The support structure according to claim 1 further including several adjacent base modules arranged so that the platforms fit into each other, and wherein the platforms of the tier "n" are adjacent and contiguous and comprise a connection mechanism arranged to limit their relative displacement.

23. The support structure according to claim 22 wherein the connection mechanism is made of a flexible elastic connection arranged around the contiguous contacts of two contiguous platforms.

* * * * *